US005476154A

United States Patent [19]

Sage

[11] Patent Number: 5,476,154

[45] Date of Patent: Dec. 19, 1995

[54] POWERED OIL CHANGE APPARATUS

[75] Inventor: Gary H. Sage, Dalhart, Tex.

[73] Assignee: Oil-Vac, Inc., Dalhart, Tex.

[21] Appl. No.: 203,370

[22] Filed: Mar. 1, 1994

[51] Int. Cl.[6] ..... F16N 33/00

[52] U.S. Cl. ..... 184/1.5; 184/6.28; 184/55.1; 184/57; 141/65; 141/67; 141/68; 222/83; 222/399; 7/100

[58] Field of Search ..... 184/1.5, 55.1, 184/57–59, 6.28, 105.3; 123/196 R; 141/363, 365, 366, 375, 65, 67, 68; 222/83, 399; 7/100; 210/233, 248; 134/169 A; 417/364

[56] References Cited

U.S. PATENT DOCUMENTS

| | | | |
|---|---|---|---|
| 1,488,377 | 3/1924 | Carrau . | |
| 2,134,004 | 10/1938 | Pittman . | |
| 2,755,969 | 7/1956 | Rainero . | |
| 3,216,527 | 11/1965 | Lewis . | |
| 3,331,405 | 7/1967 | Gaudet . | |
| 3,867,999 | 2/1975 | Cox . | |
| 3,954,611 | 5/1976 | Reedy | 184/1.5 |
| 4,095,672 | 6/1978 | Senese . | |
| 4,101,000 | 7/1978 | Scully . | |
| 4,128,140 | 12/1978 | Riches . | |
| 4,341,568 | 7/1983 | Tenney | 417/364 |
| 4,745,894 | 5/1988 | Laipply et al. . | |
| 4,865,156 | 9/1989 | Poling | 184/1.5 |
| 4,976,233 | 12/1990 | Bedi et al. . | |
| 4,991,634 | 2/1991 | Tudek | 184/1.5 |
| 5,048,578 | 9/1991 | Dorf et al. . | |
| 5,154,775 | 10/1992 | Bedi | 123/196 R |
| 5,299,714 | 4/1994 | Kilgore | 7/100 |

FOREIGN PATENT DOCUMENTS

| | | | |
|---|---|---|---|
| 0562832 | 12/1957 | Belgium | 184/1.5 |

*Primary Examiner*—Edward K. Look
*Assistant Examiner*—Christopher Verdier
*Attorney, Agent, or Firm*—Richard C. Litman

[57] ABSTRACT

Oil changing apparatus including an oil storage tank and a gasoline powered air compressor, both mounted on the bed of a trailer. An oil hose communicates with the storage tank, and connects into a motor being serviced. The drain plugs of motorized equipment serviced by the oil changing apparatus are provided with quick coupling connectors. The oil hose has a cooperating connector at its distal end, which connects to the modified drain plug. The drain plug connector includes a normally closed valve, to retain oil in the sump when the oil hose is not attached thereto. A first air hose enables the air compressor to draw air from the storage tank in the oil drain mode. Oil is removed from the serviced motor by suction. In the purge mode, accumulated old oil is rapidly purged from the tank. A second air hose conducts pressurized air from the compressor to the storage tank, which forces oil from the storage tank when emptying the same. An accessory enables purging an oil filter cartridge with the novel apparatus. The accessory comprises a conduit having a pointed end, a quick coupling connector for attachment to the oil hose, and an integral slide hammer for assisting in piercing the cartridge. The resultant oil changer is mobile, of minimal complexity and cost, built from readily available parts and materials, and is not reliant upon availability of electrical power or sources of compressed air or vacuum.

9 Claims, 3 Drawing Sheets

POWERED OIL CHANGE APPARATUS

BACKGROUND OF THE INVENTION

1. Field of the Invention

The present invention relates to apparatus for evacuating lubricating oil in situ from the crankcase and oil filter of an engine, storing and transporting the removed oil, and discharging the removed oil at an oil collection facility.

2. Description of the Prior Art

Internal combustion engines are generally lubricated by oil, which deteriorates during service, and which must periodically be changed. Removal of this oil from the crankcase of an engine is time consuming, and prone to leaks and spills, which may permeate the ground in the vicinity of the leak or spill.

The prior art has proposed a variety of schemes employing a variety of apparatuses to improve the efficiency of removal of old oil from and dispensing new oil to engines. The following patents are examples of systems mounted on wheels.

U.S. Pat. No. 4,095,672, issued to Frank J. Senese on Jun. 20, 1978, discloses a pressure operated oil draining apparatus which is supported on a wheeled truck. A compressed air tank is employed to provide suction drawing oil through a dipstick conduit by application of the Bernoulli principle.

U.S. Pat. No. 3,867,999, issued to Robert G. Cox on Feb. 25, 1975, discloses a pressure operated system for draining oil which is also disposed, in one embodiment, upon a wheeled truck. A vacuum pump provides suction for removing the oil. A readily mating coupler is employed to connect a hose to the engine for draining old oil.

U.S. Pat. No. 2,755,969, issued to Giovanni Rainero on Jul. 24, 1956, discloses a an oil replacement system employing an air compressor, and utilizing both suction and discharge sides of the pump to provide both suction and pressure to remove old oil and to inject new oil.

Additional systems, not explicitly described as being mobile, include U.S. Pat. Nos. 4,128,140, issued to Stanley J. W. Riches on Dec. 5, 1978, and 3,216,527, issued to Oliver G. Lewis on Nov. 9, 1965. Both references are directed to pressure operated systems for both draining old oil and refilling with new oil. The latter reference discloses a system relying upon both a vacuum pump and a separate source of compressed air.

In order to be compatible with existing motorized equipment, interfacing connectors are frequently required. A commonly employed point of interface is the threaded plug closing the sump of an engine. Most apparatuses for expediting oil removal require a plug adapted for ready connection and disconnection of a hose which leads back to the suction component of the oil draining device.

Examples are seen in the following references. U.S. Pat. Nos. 5,048,578, issued on Sep. 17, 1991, to Arkady Dorf et al., and 4,745,894, issued to Robert A. Laipply et al. on May 24, 1988, disclose drain plugs adapted to include a fitting enabling rapid connection to an oil draining conduit. Both references include spring biased valves unseated upon mating with a corresponding coupling.

U.S. Pat. No. 4,976,233, issued to Ram D. Bedi et al. on Dec. 11, 1990, discloses a T-fitting for attachment, at one side of the T, of a conventional drain plug, and at the other side of the T to a conduit utilized in pressure based evacuation of old oil.

None of the above inventions and patents, taken either singly or in combination, is seen to describe the instant invention as claimed.

SUMMARY OF THE INVENTION

The present invention is particularly directed to apparatus suitable for transport to equipment requiring oil changing. This equipment may be remote from utilities, such as compressed air, vacuum, electrical power, and even hoists. Even as the invention addresses this need, it also has the purpose of minimizing cost and complexity.

A complete oil changer would include apparatus devoted to supplying fresh oil. However, this aspect of changing oil involves considerably less effort than draining the old oil. Removal of old oil is frequently rendered more difficult since an oil sump is typically located at the bottom of the vehicle. For the usual threaded drain plug to be removed, the motorized equipment may have to be hoisted in order to provide sufficient access.

A second consideration is that of controlling leakage. Old engine oil is held to constitute an environmental hazard, and spillage is not tolerable.

The present invention provides apparatus employing a push-on, quick coupling connector which obviates the need for enhanced access to the oil drain in almost all cases. Space required to enable draining is limited to that enabling a person's arm to reach under the vehicle, and push a flexible hose into attachment by the quick coupling connector.

By contrast, adding fresh oil is performed at the top of the engine. Because gravity draws oil downwardly, an oil fill cap need not require the tight threaded connection required by drain plugs, and is readily removable by hand. Because the top of an engine naturally affords superior access, and because no tool is ordinarily required to remove an oil fill cap, replenishing oil is easily accomplished without requiring specialized equipment to expedite the same.

Taking advantage of this situation, the novel powered oil change apparatus of the present invention removes or drains old oil, and is not encumbered with oil refilling equipment. The novel powered oil change apparatus includes an air compressor powered by an internal combustion engine and an oil storage tank, both mounted on a road going trailer.

By mounting the oil draining apparatus on a road going trailer, the apparatus of the present invention is efficiently moved to each piece of equipment requiring servicing. In many cases, it would not be feasible to transport the equipment to a central service facility of the sort envisioned by Lewis '572 or Riches '140. For example, large earth moving or farm equipment is inefficient to operate merely for transport to a service facility, or may require a special permit to traverse a public road. Some equipment is not mobile, such as dewatering or irrigation pumps, or stationary generators.

Furthermore, a fleet operator may find that his equipment is dispersed over a wide area. It is likely more efficient to make a circuit, bringing a service vehicle to each piece of equipment, than it is to move each piece of equipment to a service facility.

An oil hose communicates with the storage tank, extending to the motor being serviced, and is fitted with a quick coupling connector. High and low pressure air hoses communicate between the tank and an air compressor.

Each engine intended to be serviced by the oil changer of the present invention is provided with a drain plug adapted to include a conventional quick coupling connector corresponding to that of the oil hose. It is immaterial which connector is male and which is female, provided that the connector included with the drain plug include the usual spring biased, normally closed valve.

This arrangement enables the sump of the subject engine to remain closed whenever the oil hose is not attached thereto. The conventional quick coupling connectors make connection so quickly that there is substantially no leakage during coupling and uncoupling. Also, the time required to make connection is nominal.

Oil is drained by connecting the oil tank to the suction side of the air compressor. With the oil hose connected first, operating the air compressor evacuates the storage tank, which quickly evacuates old oil from the engine being serviced. The oil hose is pulled free, and fresh oil can be added when desired.

The present oil changer is then moved to the next equipment requiring service, and the operation is repeated. When the tank is full of old oil, the oil changer is brought to a disposal facility.

Oil is efficiently drained from the tank by reversing operation of the air compressor. The oil tank is subjected to high pressure from the air compressor discharge side. An oil drain conduit is located above the mouth of a receptacle for accepting old oil at a suitable disposal facility, and the compressor is operated. Oil is quickly driven by pneumatic pressure through the oil hose, into the disposal receptacle.

The difficult chore of draining old oil from many different types of motorized equipment is thus facilitated, and even draining of the old oil from the present oil changer is expedited.

The equipment required to accomplish these goals is uncomplicated and based on existing, widely available, standardized industrial equipment, and the cost is thereby minimized.

Improvements to the art introduced in the present invention are many. It will be noted that a single pressure device, that being the air compressor, is employed. This is unlike the separate compressor and vacuum pump of Cox '999. Also, vacuum is directly derived from the air compressor, unlike those schemes employing indirect derivation by an air compressor, such as are exemplified by Cox '999 and Riches '140. Apparatus is minimized by causing the air hose to be selectively attachable to suction and discharge sides of the air compressor. This is in contrast to the scheme of Rainero '969, which requires additional conduits and valves. In fact, all equivalent prior art schemes known to the applicant require more apparatus than is employed in the instant invention.

The internal combustion engine power source obviates reliance on external power, such as the electrical connection required by Cox '999, or the external supply of compressed air required by Riches '140.

Connection of the oil hose to the serviced motor is to a larger orifice than is customarily possible with suction probes inserted in a dipstick well, as taught by Rainero '969, Lewis '527, and Senese '672.

Standard quick coupling connectors are employed in the present invention. This is unlike the complicated or non-standard devices of Laipply et al. '894, Bedi et al. '233, Dorf '578, and the conversion kit (element 14 of FIGS. 1 and 2) of Cox '999.

Finally, the incorporation of a trailer by the present invention solves a transport problem not addressed even in the wheeled carts of Rainero '969 and Senese '672. This is the ability to be used on public roadways, and thus enable the oil changer to be brought to equipment being serviced, rather than bring the various equipments to a maintenance facility.

An oil filter cartridge may also have to be drained, prior to removal from its engine. A tool for piercing the filter and providing a connection compatible with the novel pneumatic system is also encompassed by the invention.

Accordingly, it is a first object of the invention to provide a mobile, readily towed oil change apparatus which is legally usable on public roads, so that equipment being serviced need not be transported to a central maintenance facility.

A second object of the invention is to provide an oil change apparatus which is readily connected to and disconnected from motorized equipment.

It is again an object of the invention to provide an oil change apparatus which has inherently leak resistant connection to motorized equipment being serviced.

A fourth object of the invention is to minimize modification to motorized equipment to be compatible with the present oil change apparatus.

It is another important object of the invention to minimize the number and complexity of components employed in the invention.

It is a further object of the invention to employ standard, widely available components to manufacture the present oil changer.

Still another object of the invention is to provide a self-sufficient power source for the present oil changer, whereby the oil changer is independent of external power or utilities.

An additional object of the invention is to provide a single pumping device for producing both pressure and vacuum.

Yet another object of the invention is to avoid relying on apparatus employing the Bernoulli effect to produce vacuum.

Still a further object of the invention is to enable rapid emptying of the old oil storage tank of the present oil changer.

A significant object of the invention is to provide apparatus simultaneously satisfying those objects set forth hereinabove.

Still another object of the invention is to provide a ready connection between the oil change apparatus and an oil filter, thus enabling ready evacuation of the filter prior to removal from the engine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
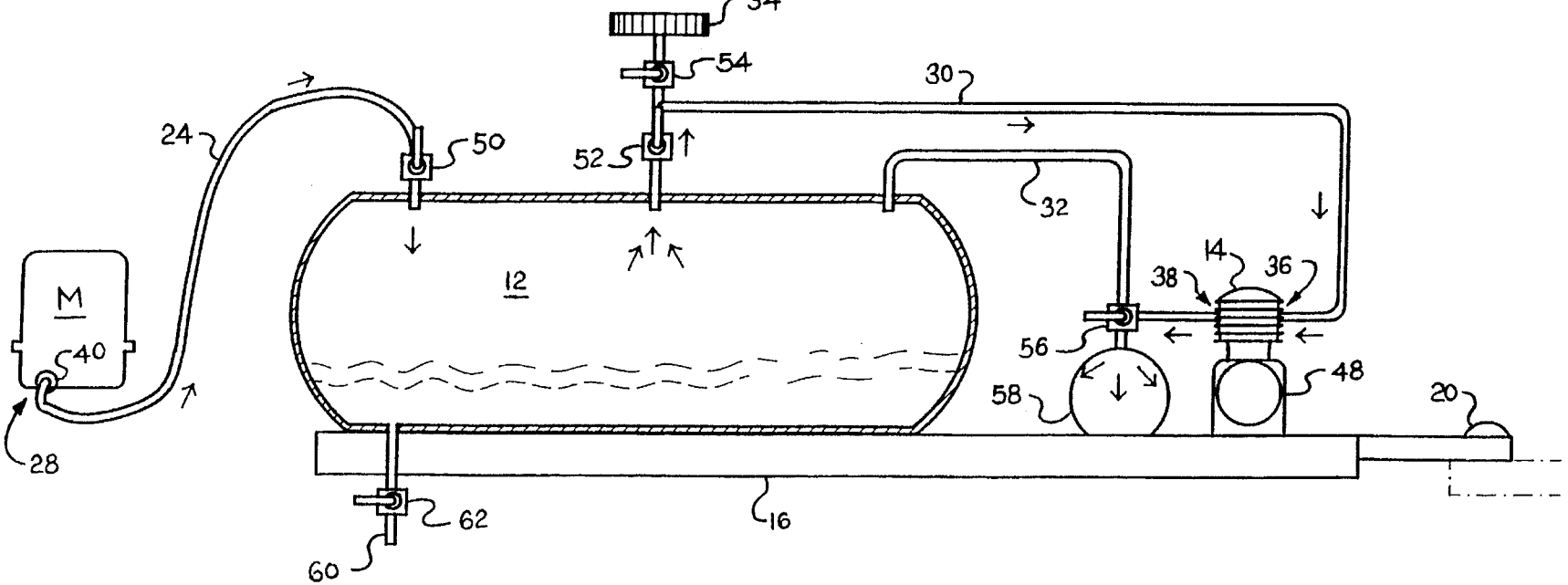
FIG. 1 is a diagrammatic, environmental, side elevational view of the invention, shown partially in cross section, and illustrating removal of oil from a vehicle being serviced.

Turning now to FIG. 1 of the drawings, the present oil changing apparatus generally indicated by 10 includes an oil storage tank 12 and an air compressor 14, both mounted on a trailer 16. Trailer 16 has sufficient rating to be legally operable on public highways, and includes a trailer hitch 20 or other suitable apparatus for attachment to a tow vehicle (not shown).

An oil hose 24 extends into and communicates with the interior of tank 12. Oil hose 24 terminates at its other end in one member 8 of a pair of mating, quick coupling connectors well known in the art of hydraulic conduits.

A suction air hose 30 communicates with tank 12, terminating at the top thereof at one end. The other end of air hose 30 is connected to the inlet, or suction side 36 of air compressor 14. A pressurized air hose 32 is connected to the discharge, or high pressure, side 38 of air compressor 14. A filtered air inlet 34 is provided, and its function will be described hereinafter.

Air hose 30 is connected to suction side 36 when draining oil from a motor M being serviced. Operation of air compressor 14 will then induce a partial vacuum in tank 12, which forcibly and rapidly evacuates old oil from the sump of motor M.

Figure 2:
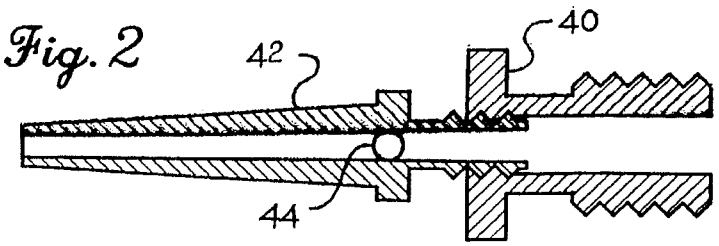
FIG. 2 is a cross sectional detail view of a modified drain plug, indicated at the left of FIG. 1, and drawn to enlarged scale.

Connection of apparatus 10 to motor M is as follows. The drain plug 40 of motor M is modified, as shown in FIG. 2, to include a corresponding coupling member 42 which mates with member 28. Modified drain plug 40 is left permanently in place in motor M, and subsequent oil removal will be quickly and easily accomplished. To assure that engine oil be retained in the sump of motor M, coupling member is selected to include a valve 44 biased to the closed condition.

To operate in the oil draining mode, firstly, oil hose 24 is connected to drain plug 40, and then air compressor 14 is operated. Oil hose 24 is readily pushed into solid engagement with coupling member 42 and pulled therefrom by hand, once the modification to drain plug 40 is complete.

Figure 3:
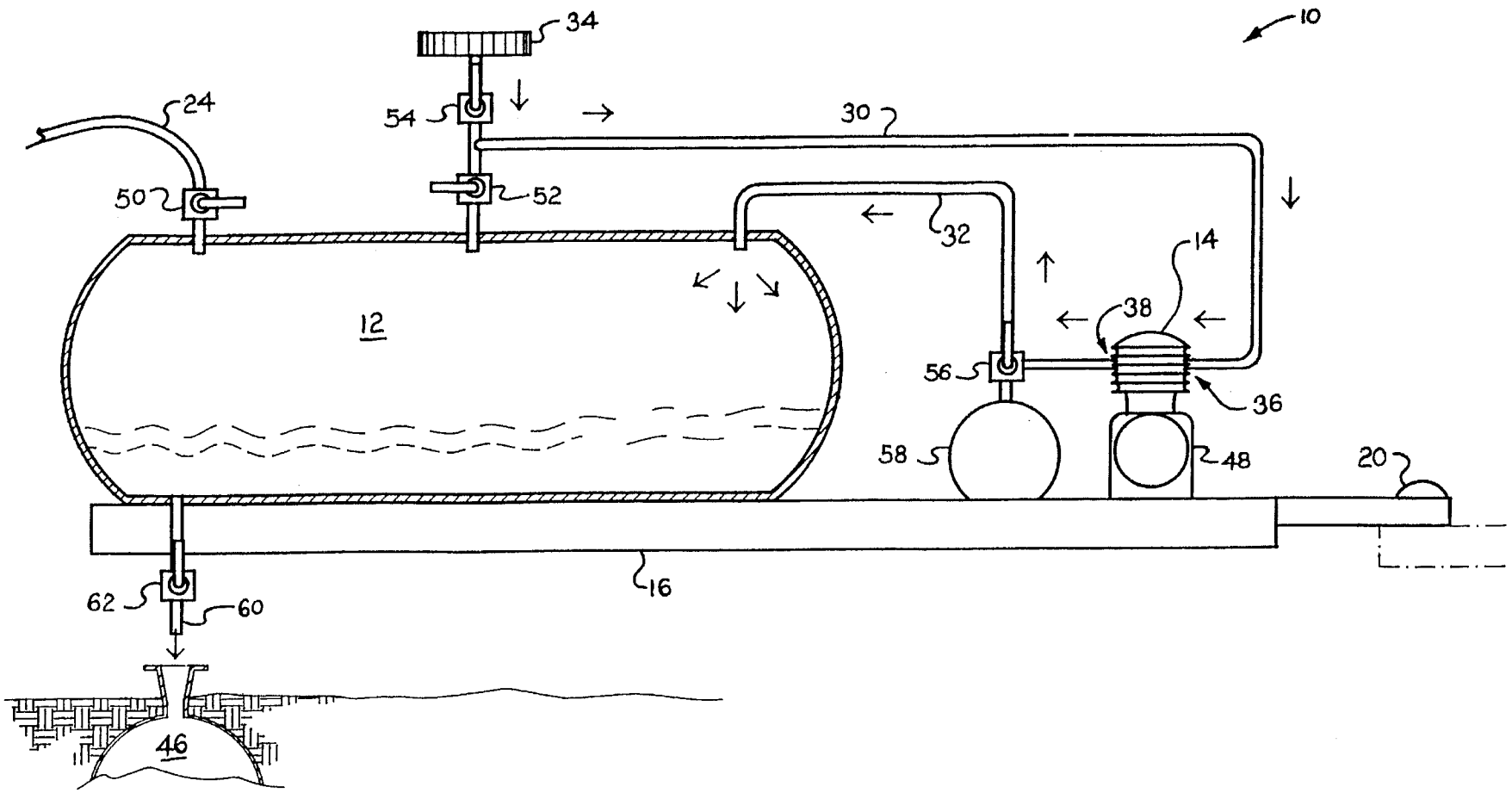
FIG. 3 is a diagrammatic, environmental, side elevational view of the invention, shown partially in cross section, and illustrating emptying of the oil storage tank of the present oil changer.

Referring now to FIG. 3, tank 12 will eventually fill with old oil, and emptying will be required. Apparatus 10 is brought to a suitable oil disposal facility which includes a waste oil tank 46. Oil drain conduit 60 is located above the mouth of tank 46, and apparatus 10 is connected for operation in the tank emptying mode.

This requires that air be supplied from air hose 32, which is connected to discharge side 38 of air compressor 14. When air compressor 14 is operated, resultant pressure will expeditiously force oil out of tank 12 through drain conduit 60, into storage tank 46.

A preferred scheme of conduits and valves will now be described. Returning to FIG. 1, a valve 50 selectively opens and closes communication of oil hose 24 with the interior of tank 12. When drawing old oil from motor M, this valve 50 is open. Valve 52 is open, and valve 54 is closed, so that air is drawn into air compressor 14 only from tank 12, and not from air inlet 34. Finally, valve 56, which is a three way valve, is moved to communicate between discharge side 38 and a compressed air tank 58. Although air could be vented to the atmosphere rather than stored in tank 58, the provision thereof enables unrelated operations to be performed, taking advantage of the presence of air compressor 14. The direction of flow of air and oil in the conduit and valve arrangements discussed herein is indicated in FIGS. 1 and 3 by arrows.

Again referring to FIG. 3, and now describing the oil purging mode, operation of valves 50, 52, 54, and 56 is reversed. Valve 56 is moved to communicate between discharge side 38 and tank 12 through conduit 32. An oil drain conduit 60 is employed to discharge old oil to waste tank 46. Valve 62, which controls conduit 60, is opened to enable escape of oil, and is closed at other times. Air flows to suction side 36 from filtered air inlet 34.

It is desirable to expedite emptying of tank 12 since it may contain a large quantity of old oil. The applicant has determined that a 150 gallon (570 liter) tank provides a convenient size. Allowing for the space within tank 14 devoted to air, there nonetheless remains space to accept oil from up to roughly one hundred ordinary passenger vehicles. Obviously, this volume clearly justifies powered purging.

An internal combustion engine 48 is employed to power air compressor 14 for two reasons. The first is that engine 48 can feasibly carry integral therewith a fuel supply (not shown), so that the power plant is independent of connection to electricity or other utilities. The second reason is that single cylinder engines are commonly available, and power output of existing such engines is well matched to the load. A 5 horsepower (4 kW output) engine serves well in the capacity of a power plant, both to drain oil from engines, and to expel accumulated oil from tank 12.

Figure 4:
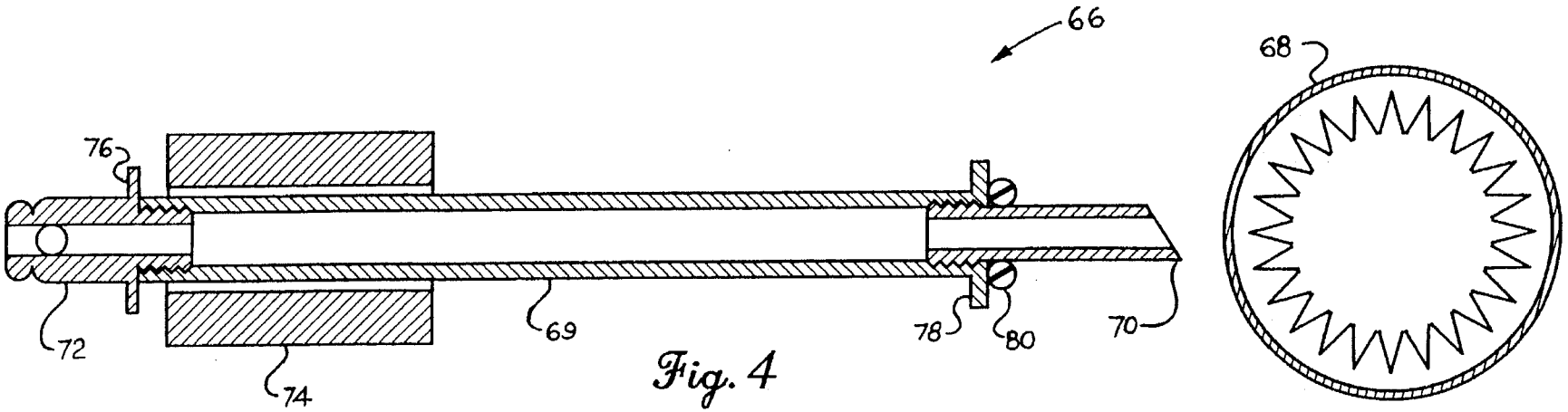
FIG. 4 is a diagrammatic, side cross sectional detail view of a present tool for piercing an oil filter and enabling ready connection to the apparatus illustrated in FIG. 1, drawn to enlarged scale.

An accessory 66 for operably connecting hose 24 (see FIG. 1) to an oil filter cartridge 68 is shown in FIG. 4. Accessory 66 includes a conduit 69 having a pointed end 70 and a coupling member 72, equivalent in characteristics to the coupling member shown in FIG. 2 and described hereinabove. A slidably mounted weight 74 is disposed upon conduit 69, retained thereon by flanges 76, 78. An O-ring 80 is provided outside flange 78.

Figure 5:
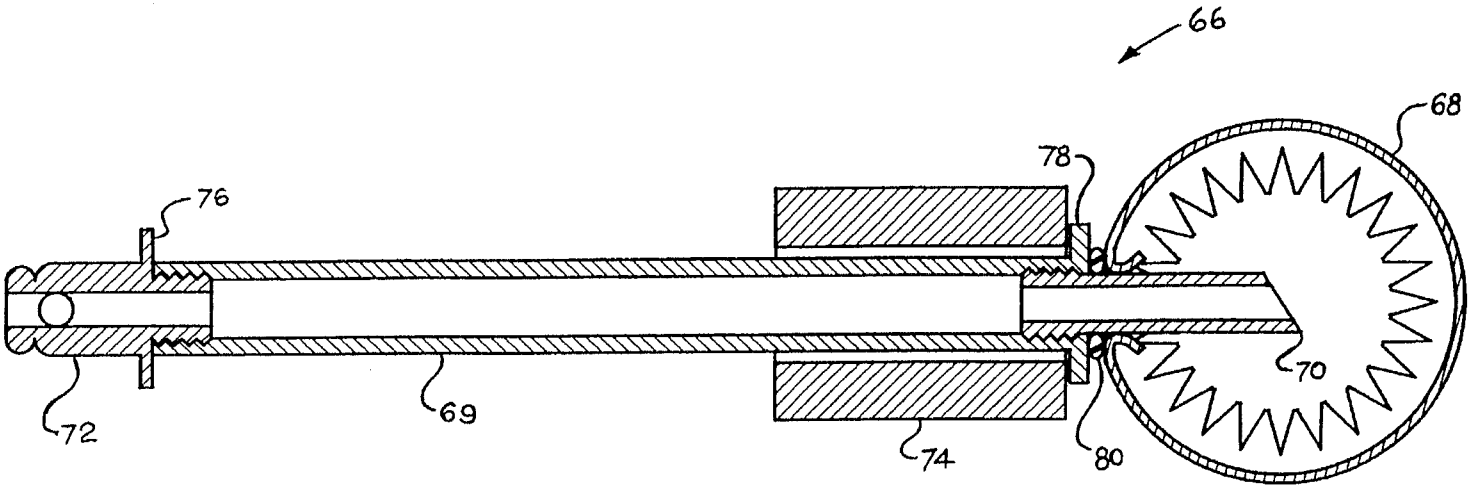
FIG. 5 is a diagrammatic, side cross sectional view of the tool of FIG. 4, showing it inserted into an oil filter cartridge.

As shown in FIG. 5, accessory 66 penetrates oil filter cartridge 68 by placing pointed end 70 against cartridge 68, and then sliding weight 74 rapidly into flange 78, weight 74 operating as a slide hammer. Hose 24 is then attached to coupling member 72, and oil can be drained from cartridge 68. This enables cartridge 68 to be removed from motor M when empty, thus reducing risk of spilling old oil therefrom. In many vehicles, the oil filter cartridge is threaded onto a base in a position normal thereto, or upright, with entry and egress openings facing downwardly. In these cases, oil is preferably drained from the cartridge prior to removal from the engine.

Thus, it will be appreciated that a remarkably uncomplicated, yet efficient oil changing apparatus is described. The apparatus requires one tank, one powered air compressor, three conduits which can be made up from commonly available hoses, and appropriate coupling connectors. The apparatus is readily transported to undeveloped terrain, such as farms, construction sites, quarries, and the like, and yet is also transportable on public roads, which facilitates transfer of old oil to established disposal facilities.

Actual dimensions and capacities of the components of present apparatus 10 may be selected according to the intended application. Conduits and valves arrangement may be varied as desired.

It is to be understood that the present invention is not limited to the sole embodiment described above, but encompasses any and all embodiments within the scope of the following claims.

I claim:

1. A powered, mobile oil change apparatus comprising:

an oil storage tank having an interior;

an air compressor having a suction side and a discharge side;

an oil conduit having proximal and distal ends, said proximal end communicating with said interior of said oil storage tank, and said distal end including one member of a pair of mating, quick coupling connector members;

a first air conduit communicating between said oil tank interior and aid air compressor section side, there being a first valve selectively enabling and stopping air flow within said first air conduit, and a second air conduit communicating between said air compressor discharge side and said oil interior, there being a second valve selectively enabling and stopping air flow within said second air conduit; whereby said powdered mobile oil change apparatus is selectively operated in an oil draining mode and in an oil tank emptying mode. By selecting connection thereof to one of said air compressor suction and discharge sides and operating said first and second valves and operating said air compressor.

2. The powered, mobile oil change apparatus according to claim 1, further comprising a trailer including means for attachment to a tow vehicle, said oil storage tank and said air compressor being supported upon said trailer.

3. The powered, mobile oil change apparatus according to claim 1, said air compressor including a power plant comprising an internal combustion engine.

4. The powered, mobile oil change apparatus according to claim 1, there further being at least one drain plug having means defining a bore therethrough and including a corresponding coupling member of said pair of mating, quick coupling connector members, said drain plug installed in a sump of equipment requiring oil changing, whereby said powered, mobile oil change apparatus is readily and operably connected to the equipment requiring oil changing solely by connection of said oil conduit thereto, and oil draining is accomplished by operation of said air compressor.

5. The powered, mobile oil change apparatus according to claim 1, further including an accessory for operably connecting said oil conduit to an oil filter cartridge, and purging the same of old oil when said mobile oil change apparatus is operated, comprising:

a conduit having a pointed end and a coupling member at an opposite end thereof, said coupling member cooperating with one member of said pair of mating, quick coupling connector members, and a slide hammer retained on said accessory, and operable to urge said accessory in the direction of said conduit pointed end.

6. A powered, mobile oil change apparatus comprising:

an oil storage tank having an interior;

an air compressor having a suction side and a discharge side, and an internal combustion engine supplying power thereto;

an oil conduit having proximal and distal ends, said oil conduit communicating with the interior of said oil storage tank, said proximal end communicating with said interior of said oil storage tank, and said distal end including a first member of a pair of mating, quick coupling connector members;

a first air conduit communicating between said oil tank interior and said air compressor suction side, there being a first valve selectively enabling and stopping air flow within said first air conduit;

a second air conduit communicating between said air compressor discharge side and said oil tank interior, there being a second valve selectively enabling and stopping air flow within said second air conduit; and a trailer including means for attachment to a tow vehicle, said oil storage tank and said air compressor being supported upon said trailer, whereby said powered, mobile oil change apparatus is selectively operated in an oil draining mode and in an oil tank emptying mode by selecting connection thereof to one of said air compressor suction and discharge sides by operating said first and second valves, and operating said air compressor.

7. The powered, mobile oil change apparatus according to claim 6, there further being at least one drain plug having means defining a bore therethrough and including a corresponding coupling member of said pair of mating, quick coupling connector members, said drain plug installed in a sump of equipment requiring oil changing, whereby said powered, mobile oil change apparatus is readily and operably connected to the equipment requiring oil changing solely by connection of said oil conduit thereto, and oil draining is accomplished by operation of said air compressor.

8. The powered, mobile oil change apparatus according to claim 6, further including an accessory for operably connecting said oil conduit to an oil filter cartridge, and purging the same of old oil when said mobile oil change apparatus is operated, comprising:

a conduit having a pointed end and a coupling member at an opposite end thereof, said coupling member cooperating with one member of said pair of mating, quick coupling connector members, and a slide hammer retained on said accessory, and operable to urge said accessory in the direction of said conduit pointed first end.

9. An accessory for operably connecting a suction hose fitted with one member of a pair of mating, quick coupling connector members to an oil filter cartridge, comprising:

a conduit having a pointed end and a coupling member at an opposite end thereof, said coupling member cooperating with one of said pair of mating, quick coupling connector members, and a slide hammer retained on said accessory, and operable to urge said accessory in the direction of said conduit pointed end.

* * * * *